US005806962A

United States Patent [19]

Ellion

[11] Patent Number: 5,806,962

[45] **Date of Patent: *Sep. 15, 1998**

[54] FLASHLIGHT REFLECTOR WHICH PROJECTS AN UNIFORMLY ILLUMINATED ADJUSTABLE BEAM AND CAN BE FABRICATED USING CONVENTIONAL MACHINE TOOLS

[76] Inventor: M. Edmund Ellion, 3660 Woodstock Rd., Santa Ynez, Calif. 93460

[ * ] Notice: The term of this patent shall not extend beyond the expiration date of Pat. No. 5,459,649.

[21] Appl. No.: 641,953

[22] Filed: May 1, 1996

[51] Int. Cl.[6] ..... F21L 7/00

[52] U.S. Cl. ..... 362/187; 362/282; 362/346; 362/347

[58] Field of Search ..... 362/187, 188, 362/282, 285, 346, 347, 297

[56] References Cited

U.S. PATENT DOCUMENTS 1,991,753 2/1935 Kurlander ..... 362/187
2,125,038 7/1938 Tompkins et al. ..... 362/188
4,949,231 8/1990 Wang et al. ..... 362/188
5,459,649 10/1995 Ellion ..... 362/187

*Primary Examiner*—James C. Yeung
*Attorney, Agent, or Firm*—Donald D. Mon

[57] ABSTRACT

An adjustable beam flashlight according to this invention is based in part on the teachings of Ellion U.S. Pat. Nos. 4,984,140 and 5,459,649 but adds important new concepts to describe a theoretical reflector having a broad beam that is uniformly illuminated with no bright and dull rings and no unilluminated center disc. This theoretical reflector requires manufacturing tolerances that are not available with conventional machine tools. A method is described to modify this theoretical reflector so that a practical reflector can be produced using existing machine tools. In one embodiment, the practical reflector surface is made up of a multitude of small concentric cones which reflect the light in the form of small fans. A uniformly illuminated broad beam is formed by fabricating specific groups of these cones of varying size and slope to form the reflector surface in order to project the light so as to overlap the required number of fans to produce the uniformity of illumination.

29 Claims, 3 Drawing Sheets

FLASHLIGHT REFLECTOR WHICH PROJECTS AN UNIFORMLY ILLUMINATED ADJUSTABLE BEAM AND CAN BE FABRICATED USING CONVENTIONAL MACHINE TOOLS

FIELD OF THE INVENTION

This invention is a flashlight which can selectively project uniformly illuminated beams of sizes ranging from a spot to a broad beam having no occluded center disc.

BACKGROUND OF THE INVENTION

The conventional adjustable beam flashlight employs a paraboloidal reflector to direct the light. If the light originates from a point source and is located at the focal point of the paraboloid, a concentrated spot beam is projected. As the light source is positioned farther away from the focal point, the projected beam becomes larger. The beam becomes less uniformly illuminated as the light source is positioned farther from the focal point until the center of the beam is no longer illuminated and is surrounded by a series of bright and dull rings. This dark disc is at the center of the object to be illuminated and is highly undesirable. The non uniformity with the bright and dull rings over the remaining area of the broad beam is also undesirable.

Because of the accuracy limits of the machine tools employed, the state-of-the-art reflector is not a true paraboloid. The slope of the reflector surface in numerous places differs from the paraboloid. In order to ameliorate the deviations from a true paraboloid, the reflector surface or mold from which the reflector is to be formed, is polished to smooth out the differences. While polishing will improve the performance of the reflector when projecting a sport beam, there will remain the problems for the broad beam of non uniformity of illumination, the appearance of several approximately concentric bright and dull rings and an unilluminated center disc.

The Ellion U.S. Pat. Nos. 4,984,140; 5,376,446; 5,440,463 and 5,459,649 describe two unique methods to produce a spot or broad beam without the unilluminated center disc. U.S. Pat. Nos. 5,367,446 and 5,440,463 describe unique lamps to produce the desired beams; U.S. Pat. Nos. 4,984,140 and 5,459,649 describe unique reflectors that produce the desired beams. Although the patented lamps and reflectors eliminate the unilluminated center disc, none of the four patents teaches how to produce a broad beam that is perfectly uniform in illumination. Additionally, while the reflector patents teach how to design a theoretical reflector having the desired properties to eliminate the dark center disc, the reflector can not be fabricated to the accuracy that is required using available machine tools. As a result, although the broad beam does not have a dark center disc, the beam is not uniformly illuminated and has a series of bright and dull rings of illumination.

It is the object of this invention to define the design criteria for a reflector that projects a uniformly illuminated broad beam.

Another object of this invention is to teach how to use the design criteria to design a theoretical reflector that projects a uniform intensity broad beam of illumination and that will have no unilluminated center disc.

A further object of this invention is to teach how the theoretical reflector which has uniform illumination and no unilluminated center disc can be modified so that a practical reflector can be produced using existing machine tools.

BRIEF DESCRIPTION OF THE INVENTION

This invention is a flashlight reflector that can project a spot beam approximately the same size as a conventional paraboloidal reflector but can project a broad beam of uniform illumination without the occluded center spot. This reflector is based on the principles of the Ellion U.S. Pat. Nos. 4,984,140 and 5,450,649 but describes three unique enhancements: (1) A design criteria is taught that defines the relation between the angle of the reflected light from any location on the surface of the reflector and the angle to that location from the light source, both angles referred to the axis of the axially symmetric reflector. A design using this criteria will not have the multitude of bright and dull rings in the projected broad beam as occurs with the paraboloidal reflector. (2) Using this criteria, a method is developed to design a "theoretical" reflector. However, this theoretical reflector can not be manufactured using conventional machine tools. (3) A technique is taught to modify the design of the theoretical reflector to produce a "practical" reflector using available tools. In one embodiment, the surface of the practical reflector is made up of a multitude of concentric cones. The slope and number of these conical segments is determined from the coordinates of the theoretical reflector. The final result is a reflector that has a uniformly illuminated spot and broad beam with no occluded center disc and which can be fabricated using existing machine tools.

The above and other features of this invention will be fully understood from the following detailed description and the accompanying drawings, in which:

DETAILED DESCRIPTION OF THE INVENTION

The ultimate object of this invention is to enhance the Ellion inventions described in U.S. Pat. Nos. 4,984,140 and 5,459,649 so that the broad beam has uniform illumination without bright and dull rings of light and the reflector can be fabricated using existing machine tools.

This detailed description is organized into three principal sections:

1. The design criteria for a reflector that will project a uniformly illuminated broad beam.

2. The design of the theoretical reflector that has uniform illumination using the design criteria 3. The design of the practical reflector based on the theoretical reflector coordinates that can be manufactured using conventional machine tools.

1. The design criteria for uniform illumination

It will be necessary to employ a few geometric relations in order to develop the criteria for uniform illumination. In order to reduce the teachings of this patent to the simplest form without sacrificing the rigor of the analysis, the equations will be developed in two dimensions and will assume that the light originates from a point source. Since the reflector is axially symmetric, the two dimensional equations can be transformed easily to the actual three dimensional beam. It will be made clear later how the finite length of the incandescent filament in place of a point light source affects the analysis.

The first relation to be developed will be the one that controls the uniformity of the illumination in the broad beam.

It will be helpfuil to remind the reader of the definitions of some terms that are related to light. The rate at which a point source emits light energy, evaluated in terms of its visual effects, is known as light flux. This flux is measured in lumens which is the amount of light flux radiating from a uniform one candle power source throughout a solid angle of size to surround a unit area at a distance from the source. The illumination of a surface is defined as the amount of light it receives per unit area. For uniform illumination of a surface, the ratio of total flux divided by the illuminated surface area would be equal to a constant. This requirement forms the basis for the reflector design to produce a uniformly illuminated broad beam.

Figure 1:
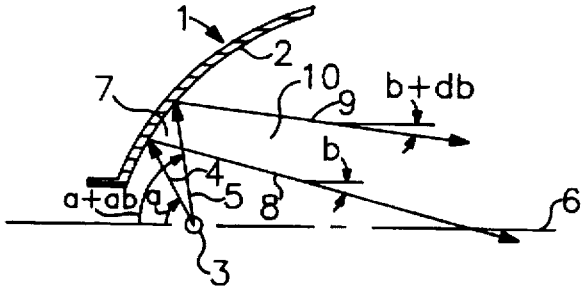
FIG. 1 illustrates light rays reflecting from a segment of a reflector.

In order to determine the illuminated surface area, consider FIG. 1. FIG. 1 illustrates a cross-sectional view of a segment of the theoretical axially-symmetric reflector 1 whose surface 2 is changing monotonically. The point light source 3 located on the axis 6 is positioned at $X_0$ to project a broad beam. Two light rays 4 and 5 are shown originating from the point light source 3 at angles "a" and "a+da" relative to the reflector axis 6, where "da" is a differentially small increment (For clarity of illustration, the light rays are shown far apart rather than the very small increment "da".) These two rays 4 and 5 bound a continuum of light 7. The continuum of light 7 that is bounded by rays 4 and 5 is reflected from the surface 2 to form a continuum of light 10 that is bounded by rays 8 and 9 at angles "b" and "b+db" relative to the axis 6.

Figure 2A:
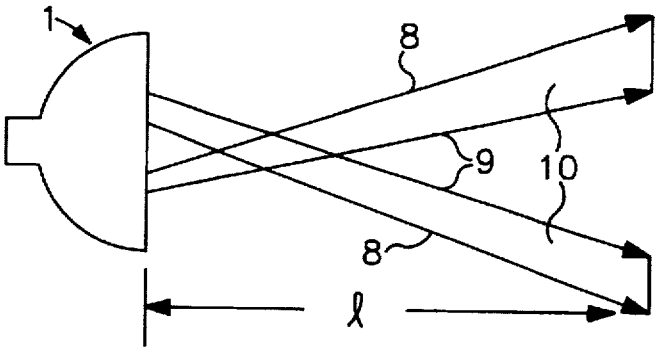
FIG. 2*a* illustrates light rays emitted from a reflector as seen from a distance.
Figure 2B:
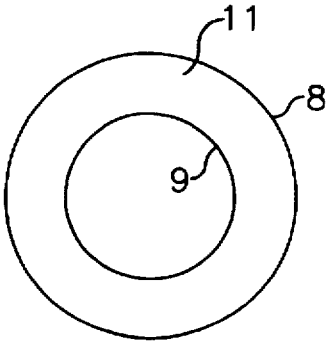
FIG. 2*b* illustrates a ring of illumination from the light rays of FIG. 2*a*

FIG. 2*a* is a view of the same axially symmetrical reflector 1 and the two light rays 8 and 9 as viewed from a distance. FIG. 2*a* illustrates a side view of the reflector and light rays while FIG. 2*b* illustrates the resulting ring shaped illumination from rays 8 and 9. Since the reflector is axially symmetric, the two light rays 8 and 9 bound a continuum of light 10 to form the illuminated ring 11 at distance as illustrated. The area of this differential ring of light will be equal to:

$$dA=2\pi\, l \tan b\, d(l \tan b) \quad (1)$$

Or $$dA=\pi\, l^2\, d(\tan b)^2 \quad (2)$$

where "l" is the distance from the reflector to the illuminated object and d(l tan b) is the thickness of the differentially small ring of illumination.

Equation 2 relates the illuminated differential area "dA" to the angle "b" of the reflected light.

Figure 3:
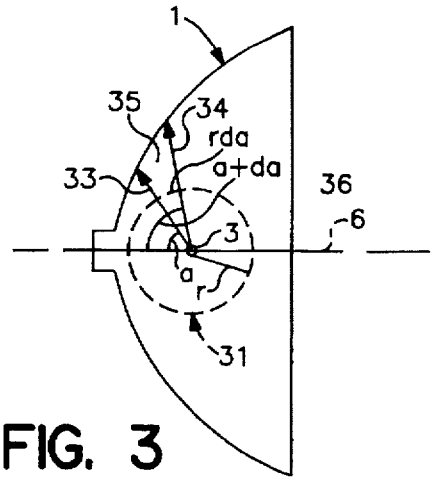
FIG. 3 shows an imaginary sphere surrounding the point light source.

It now will be shown how to determine the quantity of light flux leaving the source in terms of the angle "b" that illuminates the differential area "dA". FIG. 3 illustrates an imaginary sphere 31 of arbitrary radius "r" surrounding the point light source 3. The light can be assumed to radiate equally in all directions with flux equal to "i". The illumination on any differential area "dB" of the sphere is equal to the constant value of the flux "i" times the area "dB". The light rays 33 and are shown at angles "a" and "a+da" passing through the area "dB" of width "rda" on the imaginary sphere. As with FIG. 2, the light rays 33 and 34 are considered to bound a continuum of rays 35. If the axis of the sphere 36 is aligned to the reflector axis 6, the area of the portion of the sphere through which the continuum of light will pass is equal to:

$$dB=(2\pi\, r \sin a)r\, da \quad (3)$$

Or $$dB=(2\pi\, r^2 \sin a)da \quad (4)$$

The total light flux passing through the area "dB" will be equal to:

$$idB=(i\, 2\pi\, r^2 \sin a)da \quad (5)$$

Since the angle "a" is the same in FIG. 1 and FIG. 3, the light rays 33 and 34 are the same as rays 4 and S. Consequently, "idB" as given in equation 5 is the total flux quantity of light that will be reflected to illuminate the differential area "dA" of equation 2. Since it is desired to have uniform illumination across the entire broad beam, the ratio of equation 5 and 2 should equal a constant for all values of the angle "a":

i.e. The differential flux divided by the differential illuminated area equals a constant. (6)

$$(i\, 2\pi\, r^2 \sin a)da/[\pi\, l^2\, d(\tan b)^2]=idB/dA=\text{constant} \quad (7)$$

Integrating equation 7 and rearranging terms gives:

$$(\tan b)^2=C_1 \cos a+C_2 \quad (8)$$

where: $C_1$ and $C_2$ are constants that define the size of the reflector. The method to determine the value of these two constants will be explained later.

Equation 8 is the fundamental relation between the angle of the reflected ray "b" and the angle "a" of the light my leaving the source to establish a uniformly illuminated broad beam. This equation forms the basis to define the desired theoretical reflector; it is the design criteria for uniform illumination.

2. The theoretical reflector

The theoretical reflector will be described next. Based on the criteria for uniform illumination represented by equation 8, this reflector will produce a broad beam that has uniform illumination with no bright/dull rings and does not have an unilluminated disc at the center. After describing this theoretical reflector, it will be shown that it is impossible to fabricate it precisely with conventional machine tools. (Although the theoretical reflector can not be fabricated, the coordinates of it are needed to design the practical reflector.) The unique practical reflector of this invention will then be described that can be manufactured. The practical reflector possesses the same performance as the theoretical reflector as far as the ability to adjust from a spot beam to a broad beam, or any size in between, and where the broad beam will appear to be of uniform illumination with no bright/dull rings and will have no unilluminated disc in the center.

Although equation 8 is the criteria that shows how angles "a" and "b" must be related to obtain a uniformly illuminated broad beam, in order to design the reflector, it is necessary also to relate the reflector coordinates, the reflector surface slope and the position of the light source. As a result, a few additional relations must be employed.

The relation between the angle of the reflected light rays "b", the slope of the reflector surface "c" and the angle at which the light leave the source "a" has been derived by Ellion in U.S. Pat. No. 4,984,140 to be:

$$b=2c+a-180 \tag{9}$$

where all angle are expressed in degrees.

This equation results from the fact that the angle of incident light is equal to the angle of reflection from the reflector surface.

Figure 4:
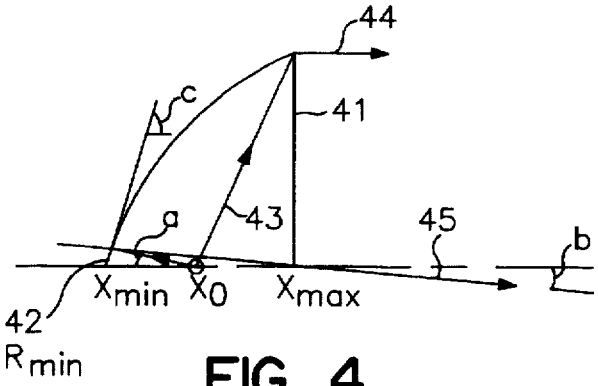
FIG. 4 shows the angles of emitted light rays and reflected light rays at the maximum and minimum diameters of a reflector.

FIG. 4 illustrates the three angles where "b" is the angle of the reflected light ray relative to the reflector axis and is negative in a clockwise direction, and "a" is the angle of the light ray leaving the source relative to the reflector axis and "c" is the slope of the reflector surface where the light ray impacts the reflector and is also relative to the reflector axis. Both angles "a" and "c" are always positive in this analysis and angle "b" is always negative.

Solving equation 9 for "c" gives:

$$c=0.5(180-a+b) \tag{10}$$

Replacing angle "b" from equation 8 gives:

$$c=0.5[180-a+\text{arc tan}(C_1 \cos a+C_2)^{0.5}] \tag{11}$$

Equation 11 defines the slope "c" of the reflector surface in terms of the angle "a" for uniform illumination; it is another form of equation 8 for the criteria for uniform illumination.

There remains the requirement to obtain a relation between the angles and the radial and axial coordinates of the reflector that will project a uniformly illuminated broad beam. A complicated differential equation that relates the radial coordinates and the angle "a" can be derived:

$$\frac{dR}{R}=\frac{\sin\{0.5[180-a+\arctan(C_1\cos a+C_2)^{0.5}]\}}{\sin a\cos\{90-a+0.5[180-a+\arctan(C_1\cos a+C_2)^{0.5}]\}}\,da \tag{12}$$

However, since this relation can not be integrated to determine the coordinates "R" in terms of "a", its complex derivation is of no practical interest. Similarly, a differential relation for the axial position "X" in terms of angle "a" can be derived but it also can not be integrated and is of no practical interest While it is not possible to relate the radial and axial coordinates to the various angles in a closed form they can be related in digit form; i.e. they can be specified with a step-by-step method.

Figure 5:
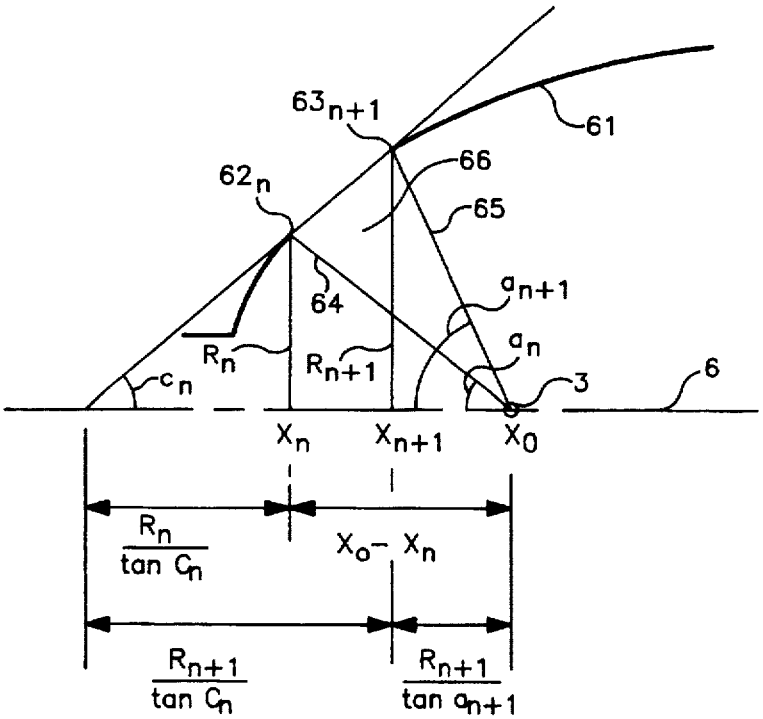
FIG. 5 defines the angles and coordinates needed to develop a digital equation.

FIG. 5 illustrates a section of the reflector 61. Points 62 and 63 on the reflector surface 61 are spaced an infinitesimal distance apart. The coordinates of point 62 will be designated "$R_n$", "$X_n$" and "$a_n$" while those of point 63 are "$R_{n+1}$", "$X_{n+1}$" and "$a_{n+1}$". For clarity, the points are shown greatly separated from one another. The point light source 3 is shown located in the broad beam position at $X_0$ on the reflector axis 6. A continuum of light 66 bounded by rays 64 and 65 impact the reflector 61 between points 62 and 63. The tangent to the reflector surface between points 62 and 63 has an angle "$c_n$" relative to the axis 6.

It can be seen from FIG. 5 that:

$$\frac{R_{n+1}}{\tan c_n}+\frac{R_{n+1}}{\tan a_{n+1}}=\frac{R_n}{\tan c_n}+X_0-X_n \tag{13}$$

Solving for $R_{n+1}$ gives:

$$R_{n+1}=[(R_n/\tan c_n)+X_o-X_n][(\tan c_n \tan a_{n+1})/(\tan c_n+\tan a_{n+1})] \tag{14}$$

The value of the slope of the reflector surface at any point may be written as:

$$\tan c_n=dR/dX=(R_{n+1}-R_n)/(X_{n+1}-X_n) \tag{15}$$

and solving for $X_{n+1}$ gives:

$$X_{n+1}=[(R_{n+1}-R_n)/\tan c_n]+X_n \tag{16}$$

Figure 6:
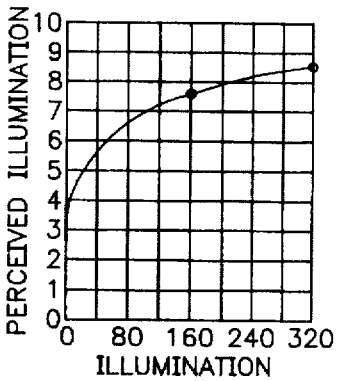
FIG. 6 shows the actual level of illumination and the level that is perceived by the human eye.

Equations 14, 15 and 16 provide the relations to conduct a step-by-step process to design the theoretical reflector. The step-by-step method is not rigorously accurate. However, it will provide a design that the human eye can not differentiate from the precise "perfect" reflector. The accuracy of the coordinates as determined by this digital technique will depend upon the size of the steps that are taken. For example, if the digital increments for angle "a" are chosen as da=0.2 degrees, the error in angle "c" and the coordinates "R" and "X" will be insignificant for a typical 2D battery size flashlight reflector which projects a 6 foot diameter broad beam at a range of 10 feet; The reason that such a crude increment of da=0.2 degrees will not affect the apparent performance of the theoretical reflector is that the human eye does not react to light intensity in a linear fashion. Instead, the eye responds to a logarithmic variation. FIG. 6 from U.S. Pat. No. 4,984,140 illustrates the actual illumination along the abscissa and the relative effectiveness of seeing by the human eye ( i.e. the perceived brightness) along the ordinate. It is seen from FIG. 6 that for a large 100 percent change in the actual intensity from 320 to 160 lumens, the human eye can only perceive a change of less than 10 percent. Similarly, a change in actual illumination of 10 percent from 320 to 297 lumens results in a perceived change of only one percent.

The method for determining the value of the two constants in equation 8 can now be explained. For the desired size of the reflector and the desired size of the broad beam, the value of the constants can be determined readily by considering FIG. 4. When the light source is located at the broad beam setting, $X_0$, the light rays 43 that are reflected from the maximum diameter 41 of the reflector emerge 44 parallel to the axis to shine on the center of the illuminated object and those 45 reflected from the minimum diameter 42 emerge at angle "b" which illuminates the outer region of the object. Equation 8 can be written for these two beams to give two equations (one for b=0 and $a=a_{max}$ and one for b=the maximum angle and $a=a_{min}$). Having two equations and two unknowns ($C_1$ and $C_2$) the value of the two constants can be determined. The angle "a" to the minimum radius can be seen to be related to the radial and axial coordinates by considering FIG. 4:

$$a_{min}=\arctan[R_{min}/(X_0-X_{min})] \tag{17}$$

If the incremental steps for ($a_n-a_{n+1}$) are chosen as 0.2 degrees, the value of $a_{n+1}$ is given by:

$$a_{n+1}=a_n+0.2 \tag{18}$$

Equations 11, 14, 15, 16, and 18 can be combined to give:

$$R_{n+1} = \frac{|\tan|0.5\cdot(180 - a_n - a\tan(\sqrt{C_1\cdot\cos(a_n)+C_2}))|\cdot\tan(a_n+0.2)}{|\tan|0.5\cdot(180 - a_n - a\tan(\sqrt{C_1\cdot\cos(a_n)+C_2}))|+\tan(a_n+0.2)}\cdot\left[\left[\frac{R_n}{|\tan|0.5\cdot(180 - a_n - a\tan(\sqrt{C_1\cdot\cos(a_n)+C_2}))|}\right]+X_0-X_n\right] \quad (19)$$

Equations 11, 18 and 19 can be combined to give:

$$X_{n+1} = \frac{\frac{|\tan|0.5\cdot(180 - a_n - a\tan(\sqrt{C_1\cdot\cos(a_n)+C_2}))|\cdot\tan(a_n+0.2)}{|\tan|0.5\cdot(180 - a_n - a\tan(\sqrt{C_1\cdot\cos(a_n)+C_2}))|+\tan(a_n+0.2)}\cdot\left[\left[\frac{R_n}{|\tan|0.5\cdot(180 - a_n - \tan(\sqrt{C_1\cdot\cos(a_n)+C_2}))|}\right]+X_0-X_n\right]-R_n}{\tan[0.5\cdot(180 - a_n - a\tan(\sqrt{C_1\cdot\cos(a_n)+C_2}))]}+X_n \quad (20)$$

All of the information that is needed to design the theoretical reflector has been presented. The steps to following in designing the reflected can be summarized as:

1. Determine the value of the constants $C_1$ and $C_2$ in equation 8 by choosing the size of the reflector and the size of the broad beam.
2. Calculate the values "X", "R" and "c" at the minimum diameter of a paraboloid that will fit into the flashlight. These are initial values for "$X_n$", "$R_n$" and "$c_n$".
3. Using equation 17, calculate the value of "$a_n$" at the minimum diameter.
4. Using equation 18, calculate the value of "$c_{n+1}$".
5. Using equation 19, calculate the value of "$R_{n-1}$".
6. Using equation 20, calculate the value of "$X_{n+1}$".
7. Continue this step-by-step process until the value of "$R_{n+1}$" equals the desired maximum radius of the reflector.

By following this digital technique, a theoretical reflector can be designed that would project a broad beam that is uniformly illuminated as perceived by the human eye and which has no unilluminated center disc. However, because the tolerances of current machine tools is ±0.0001 inches, the theoretical reflector can not be fabricated to the required tolerances. An example will be instructive:

Consider two points on the theoretical reflector surface for which the axially displacement is 0.0100 inches. The computer controlled lathe will move in a straight line between these two points. Consider the example where it is desired to have the slope of the surface between these two points equal to 44.9 degrees. From equation 9, the error in the reflected angle,b, will be twice the error in the slope of the surface. The tangent of 44.9 degrees is 0.9965154. The radial displacement to form this angle would be 0.009965154 inches. The lathe can only move 0.0100 or 0.0099 inches. The result is that the radial displacement would be 0.010 and the axial displacement also would be 0.010 inches resulting in a surface having a slope of 45 degrees. The difference between the desired 44.9 degrees and the actual 45.0 degrees would produce a reflected light ray that is 2×0.1 degrees from the desired location. This would displace the actual light ray from the desired location by 0.4189 inches at a range of 10 feet to the object being illuminated as determined by equation 21. This would result in a dull ring of light of thickness 0.42 inches. If the entire reflector were analyzed in a similar manner, it would be seen that the broad beam would have a multitude of bright and dull rings of illumination.

$$\text{Beam radius} = l \tan b \quad (21)$$

A broad beam of light made up of discrete bright/dull rings is highly undesirable. Existing paraboloidal reflectors manufactured on existing lathes that have tolerances of ±0.0001 inches are improved by polishing out the very small conical sections that result. However, in addition to the unilluminated center disc, the polished paraboloidal reflector would have a broad beam with bright/dull rings of illumination. A reflector that is manufactured from the theoretical design would produce a broad beam that has a fully illuminated center disc but would have a series of bright/dull rings. The intensity and number of these bright/dull rings would increase as the number of coordinate points is increased. If the two coordinate points are farther apart, the problem can be ameliorated. This consideration forms the basic concept for designing the "practical" reflector.

3. The Practical Reflector

It has been shown that the accuracy available from existing machine tools will produce a reflector with a broad beam that has bright/dull rings of illumination. The greater the values of ($R_n$–$R_{n+1}$) and ($X_n$–$X_{n+1}$), the easier it will be to obtain the precise values of the desired slope of the surface between the two points and consequently eliminate the rings. With this background, it is now possible to describe a reflector that approaches the performance of the theoretical reflector that has a small spot beam and a broad beam that has uniform illumination with no bright/dull rings and no unilluminated center disc.

The concept for the design of the practical reflector is to increase the incremental distance between each coordinate to the level where the slope is precisely the desired value given the possible axial and radial tolerances of ±0.0001 inches. In the simplest embodiment to describe this invention, the reflector surface is formed by a multitude of concentric cones. The size, location, slope and number of these cones are determined by the criteria for uniform illumination (equation 8 and 11) and the theoretical reflector.

The first step in designing the practical reflector is to design the theoretical reflector with the coordinates calculated to several decimal paces (e.g. 7 places). The design of the theoretical reflector will provide the information that determines the number of cones that are need to reflect light to any specific area in order to provide uniform illumination.

Figure 7:
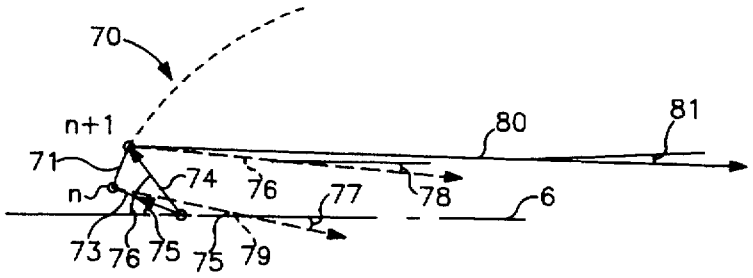
FIG. 7 illustrates a segment of the theoretical reflector shown in phantom and one conical segment of the practical reflector.

FIG. 7 will be helpful in explaining how to determine the number of cones that are needed. The figure illustrates a segment of the theoretical reflector shown in phantom 70 and one cone of the practical reflector 71 that is tangent to the theoretical segment at the minimum diameter location that is designated with subscript "n". Consider the segment of the theoretical reflector bounded by light rays 73 and 74 reflected as rays 75 and 76 having angles of 77 and 78 relative to the axis 6 as determined by equation 9. The same light rays 73 and 74 and, therefor, the same amount of total flux would reflect from the conical segment as rays 79 and 80 at angles 77 and 81. Using equation 21, it is seen that the segment of the theoretical reflector would project an illuminated ring of light with a minimum diameter $D_1$ equal to the tangent of the angle 78 times twice the distance between the reflector and the illuminated object. Similarly, the maximum diameter $D_2$ of the ring of light would be equal to the tangent of the angle 77 times twice the distance to the object. The maximum diameter of the illuminated ring of light $D_3$ that is projected by the conical segment would be the same as is reflected from the segment of the theoretical reflector since the slopes of the two surfaces are equal at the minimum diameter. However, the minimum diameter $D_4$ would be less than that projected by the segment of the theoretical reflector since angle 81 is less than angle 78 The segment of the theoretical reflector illuminates a ring having an area equal to $\pi/4(D_1^2-D_2^2)$ and the conical segment illuminates a ring having an area equal to $\pi/4(D_3^2-D_4^2)$. The level of illumination is inversely related to the area for a given value of total flux. Consequently, it is necessary to have N cones to provide the same illumination with the conical practical reflector as with the theoretical monotonically changing surface where N is:

$$N = (\text{area of illumination from the cone})/(\text{area of illumination from the segment of the theoretical reflector}) \quad (22)$$

$$= (D_3^2 - D_4^2)/(D_2^2 - D_1^2) \quad (23)$$

$$= [(\tan \text{ of angle } 77)^2 - (\tan \text{ of angle } 81)^2]/[(\tan \text{ of angle } 77)^2 - (\tan \text{ angle } 78)^2] \quad (24)$$

The procedure to follow in designing the entire practical reflector is as follows:

1. Choose the value for $(a_n-a_{n+1})$ so that the desired slope of the reflector surface can be machined with existing tools. For a reflector in a typical 2D battery flashlight that value would be greater than one degree. A convenient and practical value is two degrees.

2. Draw a conical segment tangent to the minimum radius of the theoretical reflector at $R_n$ and $X_n$ that has a slope equal to $c_n$.

3. Determine the value of $R_{n+1}$ and $X_{n+1}$ for the end of the conical segment having the desired slope $c_n$. The value of these coordinates should be precise within the tolerances of the machine tool (0.0001 inches) in order to produce the slope $c_n$. The slope can deviate from the desired value by ±0.02 degrees and only affect the broad beam diameter by less than 0.084 inches, which is less than the dispersion resulting from a finite filiment rather than a point source of light.

4. Determine the angle of the reflected rays from the segment of the theoretical reflector and the segment of the cone by equation 9, the resulting radius of the illuminated areas by equation 21 and finally the number of cones required to illuminate the area by equation 24.

5. If it is required to have a second cone illuminating the same ring as determined by equation 24, determine the slope of the second conical segment from equation 9 in order to place the reflected rays at the same location as from the first cone.

6. After providing the-required number of cones for the first ring of illumination, the next conical segment should reflect light to the edge of the light from the first group of cones.

7. Continue for the number of cones necessary to provide uniform illumination. This process continues until the minimum radius is reached.

The discussion to this point has been concerned with the broad beam. This section will discuss the spot beam. In a typical paraboloidal reflector, the spot beam is larger than the maximum diameter of the reflector because the light is not originating from a point source. The result of the bulb having a finite length filament is to produce a spot beam from a typical D-battery size flashlight that diverges from the reflector axis by approximately 4 degrees. At a range of ten feet, this divergence will produce a spot beam of approximately 1.4 feet in diameter as calculated using equation 21. When the bulb is positioned away from the focal point towards the maximum diameter (or towards the minimum diameter) in order to project a broad beam having a diameter of 6 feet, an unilluminated center disc is formed that has a diameter of approximately 1.5. feet for a D-batttery size flashlight at a range of 10 feet. The theoretical reflector previously described will fill in this unilluminated center disc by having the slope at the maximum diameter of the theoretical reflector equal to that of the paraboloidal reflector plus (or minus) one-half of the angle 4 degrees as calculated by equation 9. This increased slope will direct the reflected light from the maximum diameter towards the center by the required 4 degrees and illuminate the dark disc. Conversely, when the bulb is located at the spot beam position, the light that is projected from the maximum diameter of the theoretical reflector will diverge 4 degrees from the axis of the reflector and produce a spot beam that is approximately 1.5 feet in diameter. The light that is reflected from smaller diameters of the theoretical reflector will project into the spot beam within the 1.5 feet diameter. It is seen that the theoretical reflector will project a broad beam that is uniformly illuminated and that will project a spot beam that is approximately the same size as that from a paraboloidal reflector.

It has been shown in a previous section that in order to design the theoretical reflector, the minimum diameter segment is chosen as a small portion of a paraboloidal reflector that would fit into the flashlight. The focal point of this imaginary paraboloid is also the "focal point" of the theoretical reflector. The theoretical reflector does not have a precise focal point as does the paraboloid since it is a slightly modified paraboloid. However, placing the bulb at the focal point of the imaginary parabloid will generate a spot beam that is approximately the same size as one projected a paraboloid as was explained above.

One additional practical consideration is that the surface of the reflector should be highly polished to project the brightest beams. When the reflector is machined or if it is injection molded there would be slight helical grooves since the lathe that was used for fabrication moves a small axial distance for every revolution. Using the current state of the art, inexpensive production reflectors are coated with a thin layer of lacquer, then aluminum is deposited in a vacuum (vapor deposited aluminum, VDA) and finally a second layer of lacquer is applied in order to protect the aluminum reflective surface. The first layer of lacquer will ameliorate the small helical grooves and result in a smooth reflective surface.

Figure 8:
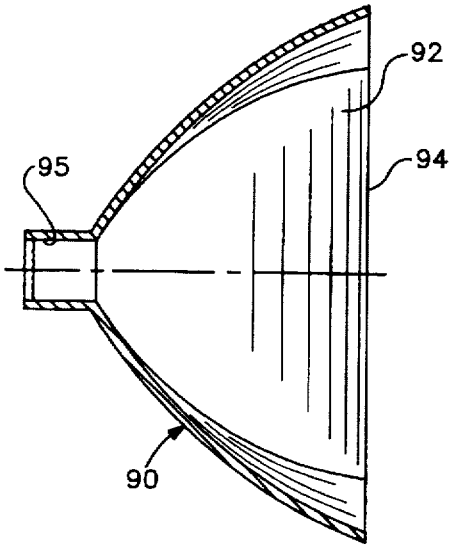
FIG. 8 illustrates a side view of a truncated reflector to reduce its size.
Figure 9:
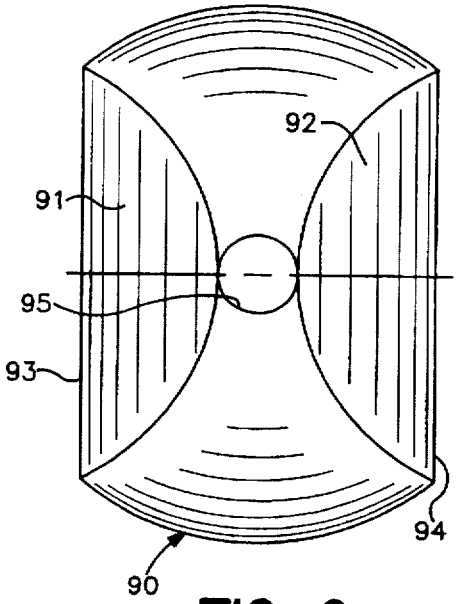
FIG. 9 illustrates an end view of a truncated reflector to reduce its size.

The foregoing has disclosed complete surfaces of revolution which would produce the maximum illumination. However, the reflector will always have a larger diameter than the body of the flashlight. Although this is true of all conventional flashlights, it may be desirable to have a smaller product. For example in FIGS. 8 and 9, a reflector 90 according to the foregoing discussion has a dimension of width in one lateral axis at its larger end reduced by forming two planar reflecting faces 91 and 92 extending from the edges 93 and 94 respectively, to near adjacency to the center hole 95. It may or may not extend through the reflecting region immediately to the hole. These slanting faces will also reflect light, but not in the same controlled pattern as the remainder of the reflector, which still will produce beams of uniform illumination and without an occluded disc. Anyone skilled in the art can envision a multitude of other truncated reflectors.

While this invention will find its greatest use in hand held flashlights, and the specifications and claims use this term, it can be scaled to any size from small hand held lamps to large searchlights that may use arcs in place of filaments as a source of the light.

This invention is not to be limited by the embodiments shown in the drawings and described in the description, which are given by way of example and not of limitations, but only in accordance with the scope of the accompanying claims.

I claim:

1. An improved reflector for a flashlight, said reflector having an internal reflective surface, a central axis, a smaller end with a region of smaller diameter and a larger end with a region of larger diameter, said surface near its smaller end having an aperture there through to pass a light emitting source and said surface at its larger end open so as to project the reflected light out of the reflector, the improvement comprising:

said reflective surface at the smaller end having the same coordinates, focal point, and slope of a true paraboloid but whose coordinates and slope deviate from those of the true paraboloid as the reflective surface extends toward the larger end, and wherein the angle between tangents between said surface and the central axis along said reflector are such that when said source is axially positioned along the central axis to a broad beam position spaced from the focal point the pattern of the reflected rays crosses the central axis in a controlled fashion in order to project a uniformly illuminated broad beam, and when the source is disposed at the focus, the reflected rays form a substantially continuous spot beam pattern.

2. A reflector according to claim 1 in which the rays emitted from the larger diameter region of the reflector surface diverge from the central axis in order to intensify the illumination at the center of said broad beam.

3. A reflector according to claim 1 in which the light source is positioned farther from the minimum diameter of the reflector than the focal point location in order to project said broad beam.

4. A reflector according to claim 1 in which the light source is positioned closer to the minimum diameter of the reflector than the focal point location in order to project said broad beam.

5. A reflector according to claim 3 in which the reflector surface has a slope at the minimum diameter equal to that of a true paraboloid but which slope increases as the reflector extends toward the maximum diameter of the surface where the reflected light is projected substantially parallel to the axis, said surface being such that rays from the light source when located at the broad beam position that are emitted towards the larger end of said reflector tend progressively to be emitted at smaller angles to the axis in such a manner that the broad beam is uniformly illuminated from its outer rim to the center.

6. A reflector according to claim 4 in which the reflector surface has a slope at the minimum diameter equal to a true paraboloid but which decreases from it to a maximum diameter of the surface where the reflected light is projected substantially parallel to the axis, the said surface being such that rays from the light source when located at the broad beam position that are emitted towards the larger end of said reflector tend progressively to be emitted at smaller angles to the axis in manner so that the broad beam is uniformly illuminated from its outer rim to the center.

7. The reflector according to claim 3 in which the reflective surface is a complete surface of revolution.

8. The reflector of claim 3 in which the portion of the reflector which is a surface of revolution is not complete and the reflector has one or more intermediate reflecting surfaces to decrease the size of the reflector in the direction of said intermediate surfaces.

9. The reflector according to claim 4 in which the reflective surface is a complete surface of revolution.

10. The reflector of claim 4 in which the portion of the reflector which is a surface of revolution is not complete and the reflector has one or more intermediate reflecting surfaces to decrease the size of the reflector in the direction of said intermediate surfaces.

11. The reflector according to claim 3 in which the angle between the emitted light rays and the central axis is related to the angle between the reflected light rays and the central axis according to the relation $$b = \arctan (C_1 \cos a + C_2)^{0.5}$$

where "a" is the angle between the central axis and the emitted rays, "b" is the angle between the reflected rays and the central axis, $C_1$ and $C_2$ are constants.

12. The reflector according to claim 4 in which the angle between the emitted light rays and the central axis is related to the angle between the reflected light rays and the central axis according to the relation:

$$b = \arctan (C_1 \cos a + C_2)^{0.5}$$

where "a" is the angle between the central axis and the emitted rays, "b" is the angle between the reflected rays and the central axis, $C_1$ and $C_2$ are constants.

13. The reflector according to claim 7 in which the diameter of said surface is less than the diameter of a true paraboloid as the diameter of the reflective surface increases to provide said broad beam.

14. The reflector according to claim 8 in which the diameter of said surface is less than the diameter of a true paraboloid as the diameter of the reflective surface increases to provide said broad beam.

15. The reflector according to claim 7 in which the diameter of said surface is greater than the diameter of a true paraboloid as the diameter of the reflective surface increases to provide said broad beam.

16. The reflector according to claim 8 in which the diameter of said surface is greater than the diameter of a true paraboloid as the diameter of the reflective surface increases to provide said broad beam.

17. The reflector of claim 13 in which the radius to any point on the reflective surface is related to smaller neighboring point on the surface by the expression:

$$R_{n+1} = \frac{[\tan[0.5 \cdot (180 - a_n - a\tan(\sqrt{C_1 \cdot \cos(a_n) + C_2}))]] \cdot \tan(a_n + 0.2)}{[\tan[0.5 \cdot (180 - a_n - a\tan(\sqrt{C_1 \cdot \cos(a_n) + C_2}))]] + \tan(a_n + 0.2)} \cdot \left[\left[\frac{R_n}{[\tan[0.5 \cdot (180 - a_n - a\tan(\sqrt{C_1 \cdot \cos(a_n) + C_2}))]]}\right] + X_0 - X_n\right]$$

where: $a_n$ is the angle between the central axis and the emitted light ray to the point on the reflector, $R_n$ is the radius to the smaller neighboring point, $X_0$ is the location of the light source along the central axis, $X_n$ is the axial position of the smaller neighboring point, $C_1$ and $C_2$ are constants.

18. The reflector of claim 14 in which the radius to any point on the reflective surface is related to smaller neighboring point on the surface by the expression:

$$R_{n+1} = \frac{|\tan[0.5\cdot(180 - a_n - a\tan(\sqrt{C_1\cdot\cos(a_n)+C_2}))]|\cdot\tan(a_n+0.2)}{|\tan[0.5\cdot(180 - a_n - a\tan(\sqrt{C_1\cdot\cos(a_n)+C_2}))]|+\tan(a_n+0.2)}\cdot\left[\left[\frac{R_n}{|\tan[0.5\cdot(180 - a_n - a\tan(\sqrt{C_1\cdot\cos(a_n)+C_2}))]|}\right]+X_0-X_n\right]$$

where: $a_n$ is the angle between the central axis and the emitted light ray to the point on the reflector, $R_n$ is the radius to the smaller neighboring point, $X_0$ is the location of the light source along the central axis, $X_n$ is the axial position of the smaller neighboring point, $C_1$ and $C_2$ are constants.

19. The reflector of claim 13 in which the axial position of any point on the reflective surface is related to smaller neighboring point on the surface by the expression:

$$X_{n+1} = \frac{\frac{|\tan[0.5\cdot(180 - a_n - a\tan(\sqrt{C_1\cdot\cos(a_n)+C_2}))]|\cdot\tan(a_n+0.2)}{|\tan[0.5\cdot(180 - a_n - a\tan(\sqrt{C_1\cdot\cos(a_n)+C_2}))]|+\tan(a_n+0.2)}\cdot\left[\left[\frac{R_n}{|\tan[0.5\cdot(180 - a_n - \tan(\sqrt{C_1\cdot\cos(a_n)+C_2}))]|}\right]+X_0-X_n\right]-R_n}{\tan[0.5\cdot(180 - a_n - a\tan(\sqrt{C_1\cdot\cos(a_n)+C_2}))]}+X_n$$

where: $a_n$ is the angle between the central axis and the emitted light ray to the point on the reflector, $R_n$ is the radius to the smaller neighboring point, $X_0$ is the location of the light source along the central axis, $X_n$ is the axial position of the smaller neighboring point, $C_1$ and $C_2$ are constants.

20. The reflector of claim 14 in which the axial position of any point on the reflective surface is related to smaller neighboring point on the surface by the expression:

$$X_{n+1} = \frac{\frac{|\tan[0.5\cdot(180 - a_n - a\tan(\sqrt{C_1\cdot\cos(a_n)+C_2}))]|\cdot\tan(a_n+0.2)}{|\tan[0.5\cdot(180 - a_n - a\tan(\sqrt{C_1\cdot\cos(a_n)+C_2}))]|+\tan(a_n+0.2)}\cdot\left[\left[\frac{R_n}{|\tan[0.5\cdot(180 - a_n - \tan(\sqrt{C_1\cdot\cos(a_n)+C_2}))]|}\right]+X_0-X_n\right]-R_n}{\tan[0.5\cdot(180 - a_n - a\tan(\sqrt{C_1\cdot\cos(a_n)+C_2}))]}+X_n$$

where: $a_n$ is the angle between the central axis and the emitted light ray to the point on the reflector, $R_n$ is the radius to the smaller neighboring point, $X_0$ is the location of the light source along the central axis, $X_n$ is the axial position of the smaller neighboring point, $C_1$ and $C_2$ are constants.

21. The reflector according to claim 13 in which the reflective surface is composed of a series of small conical segments.

22. The reflector according to claim 14 in which the reflective surface is composed of a series of small conical segments.

23. The reflector according to claim 15 in which the reflective surface is composed of a series of small conical segments.

24. The reflector according to claim 16 in which the reflective surface is composed of a series of small conical segments.

25. The reflector of claim 21 in which the number of conical segments that project light to any region is given by the relation:

$$N=|(\tan d_n)^2-(\tan d_{n+1})^2|/|(\tan b_n)^2-(\tan b_{n+1})^2|$$

where: $b_n$ is the angle between the central axis and a reflected light ray from a point on the reflector surface at location n, $b_{n+1}$ is the angle between the central axis and a reflected light ray from a point on the reflector at location n+1, $d_n$ is the angle between the central axis and a reflected light ray from a point on the reflector surface at location n, $d_{n-1}$ is the angle between the central axis and a reflected light ray from a point on the reflector at location n+1.

26. The reflector of claim 22 in which the number of conical segments that project light to any region is given by the relation:

$$N=|(\tan d_n)^2-(\tan d_{n+1})^2|/|(\tan b_n)^2-(\tan b_{n+1})^2|$$

where: $b_n$ is the angle between the central axis and a reflected light ray from a point on the reflector surface at location n, $b_{n+1}$ is the angle between the central axis and a reflected light ray from a point on the reflector at location n+1, $d_n$ is the angle between the central axis and a reflected light ray from a point on the reflector surface at location n, $d_{n-1}$ is the angle between the central axis and a reflected light ray from a point on the reflector at location n+1.

27. The reflector of claim 23 in which the number of conical segments that project light to any region is given by the relation:

$$N=|(\tan d_n)^2-(\tan d_{n+1})^2|/|(\tan b_n)^2-(\tan b_{n+1})^2|$$

where: $b_n$ is the angle between the central axis and a reflected light ray from a point on the reflector surface at location n, $b_{n+1}$ is the angle between the central axis and a reflected light ray from a point on the reflector at location n+1, $d_n$ is the angle between the central axis and a reflected light ray from a point on the reflector surface at location n, $d_{n-1}$ is the angle between the central axis and a reflected light ray from a point on the reflector at location n+1.

28. The reflector of claim 24 in which the number of conical segments that project light to any region is given by the relation:

$$N=|(\tan d_n)^2-(\tan d_{n+1})^2|/|(\tan b_n)^2-(\tan b_{n+1})^2|$$

where: $b_n$ is the angle between the central axis and a reflected light ray from a point on the reflector surface at location n, $b_{n+1}$ is the angle between the central axis and a reflected light ray from a point on the reflector at location n+1, $d_n$ is the angle between the central axis and a reflected light ray from a point on the reflector surface at location n, $d_{n-1}$ is the angle between the central axis and a reflected light my from a point on the reflector at location n+1.

29. A reflector according to claim 1 in which said reflective surface is generated by a cutting tool which leaves a track, and in which said surface includes a smooth layer of lacquer that covers said track, and a deposited highly reflective metal layer on said lacquer layer.

* * * * *